US005973255A

United States Patent [19]

Tanji

[11] Patent Number: 5,973,255

[45] Date of Patent: Oct. 26, 1999

[54] ELECTRONIC MUSICAL INSTRUMENT UTILIZING LOOP READ-OUT OF WAVEFORM SEGMENT

[75] Inventor: Ryoji Tanji, Hamamatsu, Japan

[73] Assignee: Yamaha Corporation, Hamamatsu, Japan

[21] Appl. No.: 09/082,327

[22] Filed: May 21, 1998

[30] Foreign Application Priority Data

May 22, 1997 [JP] Japan ..... 9-148646

[51] Int. Cl.[6] ..... G10H 1/40

[52] U.S. Cl. ..... 84/636; 84/604; 84/609; 84/612

[58] Field of Search ..... 84/602–606, 607, 84/609–612, 614, 634–636

[56] References Cited

U.S. PATENT DOCUMENTS 4,930,390 6/1990 Kellogg et al. ..... 84/611
4,947,723 8/1990 Kawashima et al. .
5,532,424 7/1996 Hideo ..... 84/607
5,672,836 9/1997 Yoshida et al. ..... 84/607

*Primary Examiner*—Robert E. Nappi
*Assistant Examiner*—Marlon T. Fletcher
*Attorney, Agent, or Firm*—Graham & James LLP

[57] ABSTRACT

Among the stored musical waveform in a data format, a waveform segment to be repetitively read out as a loop is designated by a user of the instrument. Upon designation of the waveform segment having a loop length LL anew, a loop time length TL is computed corresponding to the loop length LL, and the number of measures MN is determined corresponding to the loop time length TL (steps S11 and S12). Thus determined loop segment in the measure number MN is temporarily subdivided according to a sixteen-beat rhythm rate (steps S13 and S14), zero-cross points near the temporary subdivision points are then searched for, and the located zero-cross points are determined to be definitive division points (step 15). Each of the divided sub-segments are subject to time axis scaling at each scale factor such that the segment should be superimposed onto another intended musical phrase in a matched rhythm and tempo.

10 Claims, 11 Drawing Sheets

EXAMPLE OF DIVISION
BY 2 MEASURES TIMES
16 BEATS

ELECTRONIC MUSICAL INSTRUMENT UTILIZING LOOP READ-OUT OF WAVEFORM SEGMENT

BACKGROUND OF THE INVENTION

1. Field of the Invention

The present invention relates to an electronic musical instrument capable of producing a musical waveform by repetitively reading out a waveform segment in a loop from among the stored continuous musical waveform in a data format.

2. Description of the Prior Art

Among the currently prevailing music, there is a style of music in which a memorized musical phrase is repeatedly used to construct a length of music performance. Such a musical performance is formed by firstly designating a loop segment which is a waveform segment within a continuous waveform recorded and stored in the instrument and which constitutes a musical phrase to be repeatedly used in a loop, and secondly reading out the designated loop segment repeatedly to form a longer waveform for a musical performance.

And in order to superimpose the loop segment (loop phrase) on to an object phrase such as a phrase in another musical performance and a phrase in an automatic musical performance, the prior art procedure has employed the following steps:

1) previously determining a tempo for the loop phrase by calculation at human end,
2) measuring the tempo of the object phrase, and
3) compressing/expanding the time axis (time scale) of the loop phrase in accordance with the ratio between the tempo of the loop phrase and the tempo of the object phrase.

In the above-mentioned prior art procedure, however, the tempo for reading out the loop phrase should necessarily be designated previously with respect to the recorded (prepared) loop phrase, in order to compress/expand the time axis of the loop phrase in accordance with the tempo of the object phrase on which the loop phrase is to be superimposed. This procedure has been elaborate and time-consuming.

Moreover, the loop phrase should be divided into several sub-phrases for compressing/expanding the time axis, and for this purpose the user of the instrument was to designate the dividing number. But when the arbitrarily designated dividing number was inadequate, the time-axis compressed or expanded waveform might exhibit unnatural beats relative to the number of meter beats of the recorded phrase.

Furthermore, in the prior art time-axis compression/expansion technology, the compression/expansion ratio was controlled per phrase, and therefore portional control of such a ratio within a phrase was not heretofore possible. To this end, it was not possible to introduce in a phrase such a portional fluctuation of rhythm as would be caused by portionally controlling the compression/expansion ratio in a phrase.

SUMMARY OF THE INVENTION

It is, therefore, a primary object of the present invention is to provide an electronic musical instrument capable of providing easy adjustment in superimposing a loop phrase on an object phrase.

A secondary object of the present invention is to provide an electronic musical instrument capable of functioning portional control of the compression/expansion ratio of the time axis within a loop phrase.

According to the present invention, the primary object is accomplished by providing an electronic musical instrument which comprises: waveform data storing means for storing musical waveform data, loop segment designating means for permitting a user of the instrument to designate a loop segment which is a waveform segment within the stored musical waveform data to be repetitively utilized in a loop, loop length computing means for computing the length of the designated loop segment, measure number estimating means for estimating how many measures there would be in the designated loop segment in accordance with the computed loop length under the condition that a tempo of performing the designated loop segment should be of a value falling within a predetermined range, tempo determining means for determining a tempo in which the designated loop segment is to be played back, based on the estimated number of measures, and waveform playback means for playing back a musical waveform by repetitively reading out in the determined tempo the waveform of the designated loop segment. With this configuration, the length of the designated loop segment is computed, the measure number to be included in the designated loop segment is then estimated in accordance with the computed loop length, and the tempo in which the designated loop segment is to be played back is then determined based on the estimated measure number, thus the user's designation of a loop segment will complete the preparation for compressing/expanding the time axis to match the tempo for read-out, which will dispense with an elaborate tempo setting process at human side. And therefore, the preparatory procedure will be simplified, and the user can start performance on this instrument immediately.

According to the present invention, the object is also accomplished by providing a method for performing music by playing back a waveform segment repetitively in a loop, which method comprises the steps of: providing musical waveform data constituting performance of music, permitting a user of the instrument to designate a loop segment which is a waveform segment within the provided musical waveform data to be repetitively utilized in a loop, computing the length of the designated loop segment, estimating how many measures there would be in the loop segment in accordance with the computed loop length under the condition that a tempo of performing the designated loop segment should be of a value falling within a predetermined range, determining a tempo in which the designated loop segment is to be played back, based on the estimated number of the measures, and playing back a musical waveform by repetitively reading out in the determined tempo the waveform of the designated loop segment.

According to the present invention, the object is further accomplished by providing a machine readable medium for use in an electronic musical instrument of a data processing type comprising a computer and loop segment designating means for designating a waveform segment to be utilized in a loop, which medium contains program instructions executable by the computer for causing the electronic musical instrument to perform the steps of: providing musical waveform data constituting performance of music, rendering the loop segment designating means operative to permit a user of the instrument to designate a loop segment which is a waveform segment within the provided musical waveform data to be repetitively utilized in a loop, computing the length of the designated loop segment, estimating how many measures there would be in the loop segment in accordance with the computed loop length under the condition that a tempo of performing the designated loop segment should be of a value falling within a predetermined range, determining a tempo in which the designated loop segment is to be played back, based on the estimated number of the measures, and playing back a musical waveform by repetitively reading out in the determined tempo the waveform of the designated loop segment.

According to a preferred aspect of the present invention, an electronic musical instrument of the present invention further comprises: beat number designating means for designating the number of beats to be included per measure, and dividing means for dividing the waveform of the designated loop segment into a plurality of waveform sub-segments, wherein the dividing means divides the waveform of the designated loop segment into the mentioned plurality of waveform sub-segments in accordance with the estimated measure number and the designated beat number per measure. Considering the fact that the adjustment of the phrase to be looped (loop segment) in a longer continuous musical waveform is typically accomplished by a human (user's) ear hearing the repeatedly played-back loop segment to find adequate points for subdivision of the loop segment to let it fit to the object phrase such that the loop segment exhibits natural beats with respect to the object phrase, it will be apparent to the reader that the configuration of this aspect of the invention is advantageous in enabling the subdivision of the loop segment (phrase to be looped) into sub-segments at the points which are optimal for portionally scaling (compressing/expanding) the time axis, as the subdivision points for the loop segment can be determined making use of the designated measure number i.e. loop length.

According to another preferred aspect of the present invention, an electronic musical instrument of the present invention further comprises: playback tempo designating means for permitting the user of the instrument to designate the tempo in which the musical waveform is to be played back, and scale factor determining means for determining scale factors to be applied to the divided waveform sub-segments by computation based on the computed loop length, the designated beat number and the designated playback tempo, and wherein the waveform playback means reads out the divided waveform sub-segments with the determined scale factor to play back the musical waveform. With this configuration, the scale factors to be applied to the sub-segments when playing back a musical waveform are determined based on the loop length computed by the loop length computing means, the beat number designated by the beat number designating means and the playback tempo designated by the playback tempo designating means, thereby dispensing with elaborate computation of the respective tempos for the respective sub-segments of the designated loop segment to facilitate the controllability of the instrument.

According to the present invention, the secondary object is accomplished by an electronic musical instrument as configured as above for the primary object, wherein the scale factor determining means is of such an arrangement that computes a first scale factor for compressing the waveform sub-segments and a second scale factor for expanding the waveform sub-segments, and wherein the waveform playback means is of such an arrangement that plays back a musical waveform by alternately compressing and expanding the waveform sub-segments respectively using the computed first and second scale factors. With this configuration, if a longer phrase is employed in place of the above mentioned loop segment, then the scale factor (compressing/expanding factor) of the time axis can be portionally controlled within the longer phrase. Further, the pitches of the respective sub-segments may be alternately changed up and down to produce a musical waveform which sounds as bouncing, i.e. as being imparted with a swing feeling. And if the first and the second scale factor are so determined that the first scale factor may compress the waveform sub-segments by a certain amount and the second scale factor may expand the waveform sub-segments by the same certain amount, there will not occur any vacant spaces between the waveform sub-segments and thus the produced musical waveform will exhibit a more natural swing feeling.

BRIEF DESCRIPTION OF THE DRAWINGS

For a better understanding of the present invention, and to show how the same may be carried into effect, reference will now be made, by way of example, to the accompanying drawings, in which.

DESCRIPTION OF THE PREFERRED EMBODIMENTS

Figure 1:
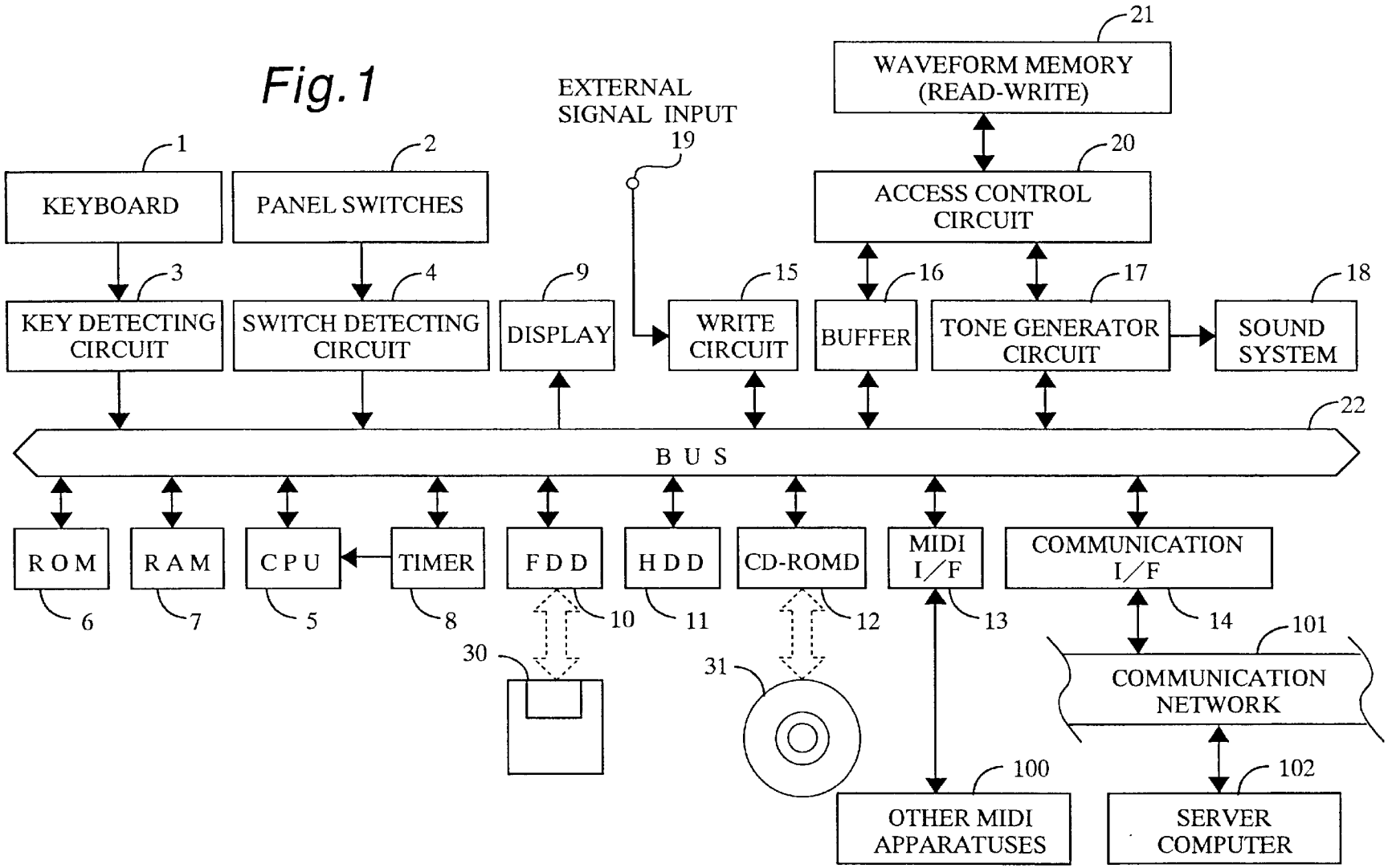
FIG. 1 is a block diagram showing an outline construction of an embodiment of an electronic musical instrument incorporating the present invention.

Illustrated in FIG. 1 of the drawings is a general block diagram of an exemplary embodiment of an electronic musical instrument incorporating the present invention. The electronic musical instrument comprises a keyboard 1 for inputting note pitch information (data), panel switches 2 including various switches for inputting various control information, a key detecting circuit 3 for detecting the depression states of the respective keys in the keyboard 1, a switch detecting circuit 4 for detecting the actuation states of the respective switches among the panel switches 2, a CPU for managing the overall control of the instrument, a ROM 6 storing control programs for the execution by the CPU 5 and table data and so forth, a RAM 7 for temporarily storing performance data, various input information, computation results and so forth, a timer 8 for counting time for various timings including interrupt timing in the timer interrupt processing, a display 9 including a large sized liquid crystal display (LCD) panel, a cathode ray tube (CRT), light emitting diodes (LED) and the like for displaying various information, a floppy disk drive (FDD) 10 for driving a floppy disk 30 as storage media, a hard disk drive (HDD) 11 for driving a hard disk (not shown) which stores various application programs including the above-mentioned control programs and various data and so forth, a CD-ROM drive (CD-ROMD) 31 for driving a compact disk read only memory (CD-ROM) 31 which stores various application programs including the above-mentioned control programs and various data and so forth, a MIDI interface (MIDI I/F) 13 for inputting MIDI (Musical Instrument Digital Interface) signals from external devices and outputting MIDI signals to external devices, a communication interface (I/F) 14 for transmitting and receiving data to and from server computers 102 or the like via a communication network 101, a write circuit 15 for writing musical waveforms inputted from external devices into a waveform memory 21, a buffer 16 for temporarily storing data such as the musical waveforms read out from the waveform memory 21 when the CPU 5 makes a read-out access to the data and for temporarily storing data such as the musical waveforms to be written in the waveform memory 21 (the waveforms are different from those inputted from external devices) when the CPU 5 writes the data, a tone generator circuit 17 for converting performance data inputted from the keyboard 1 or previously prepared in the instrument and the like to musical tone signals, and a sound system 18 including, for example, a DAC (Digital-to-Analog Converter), an amplifier, a loudspeaker and the like for converting the musical tone signals from the tone generator circuit 17 into audible sounds.

The write circuit 15 is equipped with an external signal input device 19 for inputting musical waveform signals from external devices. The external signal input device 19 may be comprised of, for example, a microphone, an amplifier and an ADC (Analog-to-Digital Converter), where the write circuit 15 does not include an ADC and the musical waveform signals inputted to the external signal input device 19 are analog signals. Or the external signal input device 19 may be a digital interface for receiving digital signals, where the musical waveform signals inputted to the external signal input device 19 are digital signals. Thus the structure of the external signal input device 19 depends on the type of the input signals and the configuration of the write circuit 15.

The tone generator circuit 17 reads out the waveform data from the waveform memory 21 at rates (speeds) respectively corresponding to the pitches instructed by the performance data, and generates tone signals for a plurality of tone processing channels in a time division multiplexed fashion. The tone generator circuit 17 of this embodiment is of a type in which only those channels that are generating tones read out the above-mentioned waveform data and includes waveform buffers for interpolation between samples, and consequently the number of the samples read out of the aforementioned waveform data per unit time varies according to the pitch designated in each channel. The waveform memory 21 is of a read-write type and the access control circuit 20 is so constructed in this embodiment as to read and write also other data than musical waveforms from and into the waveform memory 21. The access control circuit 20 functions particular control for discriminating the musical waveform data from the other data, but such a construction is not a main feature of the present invention and the description thereof is omitted herein.

The write circuit 15, the buffer 16 and the tone generator circuit 17 are connected to the waveform memory 21 via the access control circuit 20. The access control circuit 20 performs various controls such as address designation and timing instruction for the waveform memory 21, when the stored data are read out from the waveform memory 21 and when various data including musical waveform data are written in the waveform memory 21. Included in such controls is the time differentiation of accesses to the waveform memory 21 from the write circuit 15, the buffer 16 and the tone generator circuit 17.

The above-mentioned structural elements 3–17 are all connected with each other via a bus line 22, among which the CPU is connected with the timer 8, the MIDI I/F 13 is connected with other MIDI apparatuses 100, the communication I/F 14 is connected with the communication network 101 and the tone generator circuit 17 is connected with the sound system 18.

The hard disk HDD 11 may store the control program to be executed by the CPU 5 as mentioned before, and therefore, in case the ROM 6 does not store the control program, the control program may be stored in the hard disk 11 and may be transferred to the RAM 7 at the operation such that the CPU 5 may operate in the similar manner to the case where the control program is stored in the ROM 6. This manner facilitates partial addition or version renewal (version up-grading) of the control program.

Control programs and various data read out from the CD-ROM 31 in the CD-ROM drive 12 are stored in the hard disk in HDD 11. This also facilitates fresh installation of a new control program or version renewal of the stored control program. Other than the CD-ROM drive 12, the external storage devices may be with various types of media such as a magneto-optical (MO) device.

The communication I/F 14 is connected to the communication network such as a LAN (Local Area Network), the Internet and a telephone line, and therefore is connected to server computers 102 via those communication network 101. In case the above-mentioned programs and various parameters are not stored in the hard disk of the HDD 11, the communication I/F 14 is used to down load the programs and the parameters from the server computer 102. The computer (the electronic musical instrument in this embodiment) which is a client to the server transmits a command of requesting a down-load of programs or parameters to the server computer 102 via the communication I/F 14 and the communication network 101. Upon receipt of the command, the server computer 102 delivers the requested programs and parameters to the computer via the communication network 101, and the computer receives those programs and parameters via the communication I/F 14 and stores them in the hard disk of the HDD 11, thus completing the down loading. Further interfaces may be provided for directly communicating data with external computers or other apparatuses.

Herein below will be described how the electronic musical instrument constructed as above performs the controls and processes, first in outline with reference to FIG. 2 and thereafter in detail with reference to FIGS. 3–11.

Figure 2:
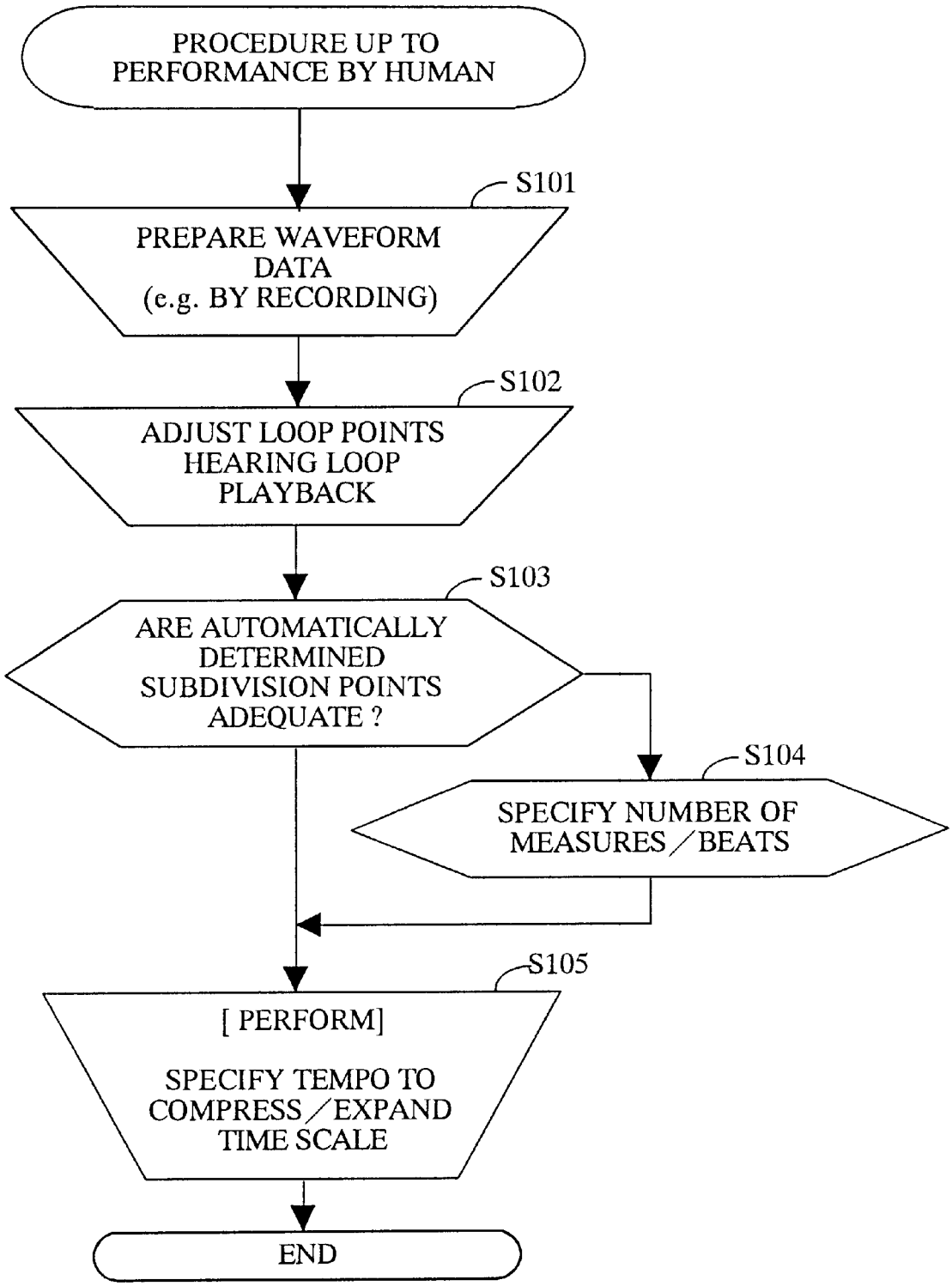
FIG. 2 is a flow chart showing the procedure conducted by a user (human) up to the start of an actual music performance on the electronic musical instrument.

FIG. 2 is a flow chart showing the flow of the procedures which a user (human) of the instrument will take before the user starts an actual performance on the electronic musical instrument of this embodiment. In this figure, wave form data for musical waveforms are stored (prepared) in the waveform memory 21 (step S101). If the intended musical waveforms have already been stored in the waveform memory 21, the above storing step is of course unnecessary. Where the intended musical waveforms are not stored in the waveform memory 21, such intended musical waveforms may be written (recorded) into the waveform memory 21 through the external signal input device 19 and the write circuit 15, or may be transferred from the RAM 7 or else if the intended waveforms are now stored in the RAM 7 or else.

Thus prepared musical waveforms are then played back, and the user designates a span (range) in the waveform which the user would like to be played back (read out) in a loop by hearing the played-back waveform. This span will hereinafter be referred to as a "loop segment" or sometimes "loop phrase". The designation will be done by selecting and adjusting the loop points (i.e. points which demarcate the loop segment within the longer musical waveform) and finally determining the most adequate points for demarcation (step S102).

Once the loop points are determined, the electronic musical instrument of this embodiment performs an automatic division of the thus determined loop segment into a plurality of waveform sub-segments (for example equally). The automatic division is performed at this stage, because it is necessary for the hereinafter described playback processing which the electronic musical instrument of this embodiment will perform, i.e. a playback processing using the technique of reading out the designated loop segment by compressing and/or expanding the time axis. The term "compressing and/or expanding" will sometimes be referred to as "scaling" in this specification.

The automatic division of a loop segment will be performed in the following manner:

1) estimating the measure number of the designated loop segment, i.e. how many measures would be included in the length of the loop segment,
2) determining the tempo for the designated loop segment based on the estimated measure number,
3) temporarily dividing the designated loop segment into the estimated measure number times a designated beat number per measure, and
4) replacing the temporary dividing points with zero-cross points of the waveform which are positioned near the respective temporary dividing points to finally determining the definitive division points.

In the above-enumerated #2), the tempo for the designated loop segment is determined also in this automatic division procedure for use in the hereinafter described playback processing, but this process is not a requisite element in the automatic division.

Figure 4:
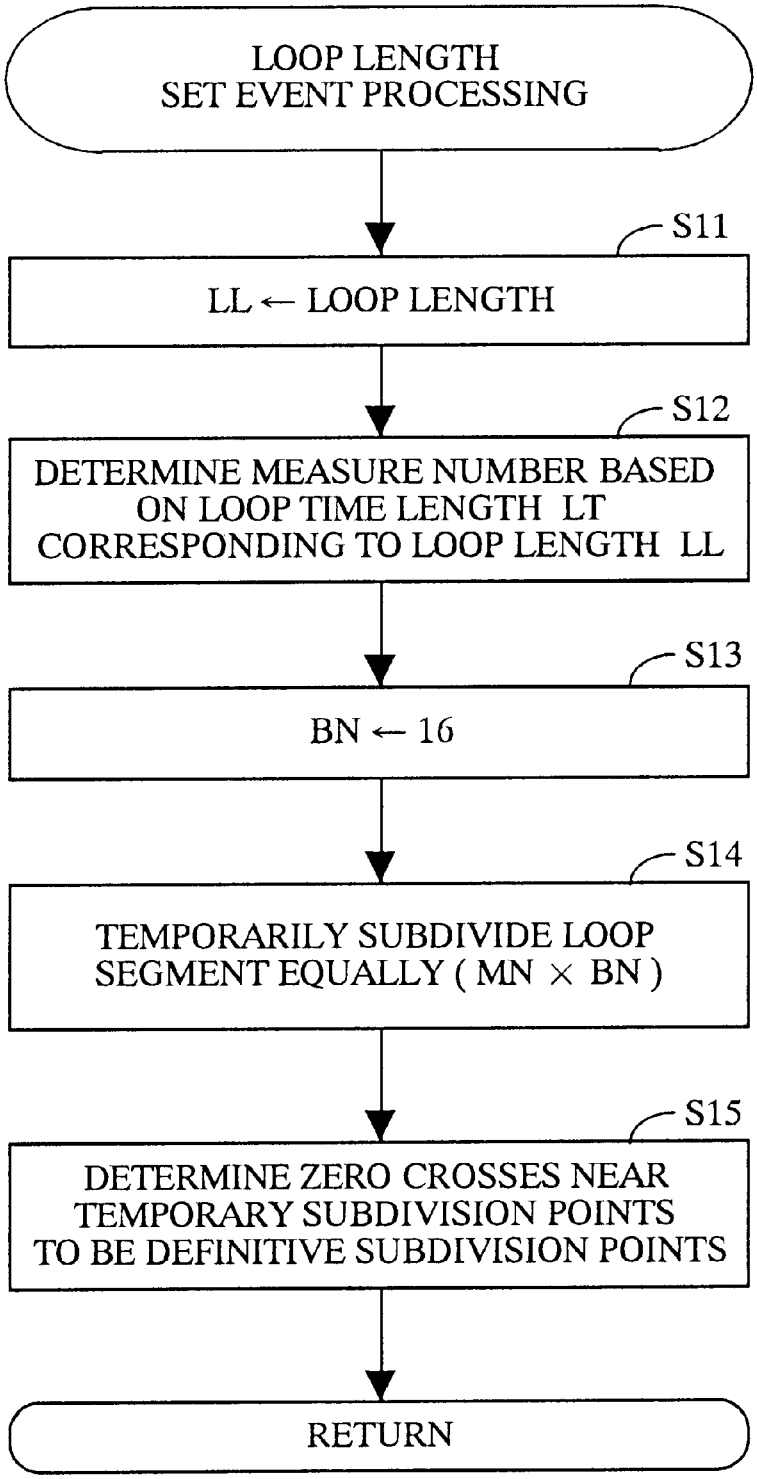
FIG. 4 is a flow chart showing the procedure of the loop length set event processing which operates when the user turns on the loop length set switch.

The above automatic division processing will be described in more detail in conjunction with the loop length set event processing with reference to FIG. 4 hereinafter. The loop length set event processing of FIG. 4 is, in the actual operation, however, performed when the user has designated a new loop length after the automatic division processing is performed. But the processing itself is similar to the automatic division processing, and therefore the description hereof will be made together with the loop length set event processing.

Then, the user will examine whether the automatically divided points are satisfactory or not by, for example, hearing the actual loop playback (step S103). If the user does not evaluate the division as being adequate, then the user will designates the elemental values for the bases of the automatic division anew, i.e. either or both of the above estimated measure number of the loop segment and the designated beat number, and the electronic musical instrument of this embodiment will automatically divide the loop segment again according to the above method using the new factors (step S104) to go forward to a stand-by state for the playback processing. On the other hand, if the user evaluates the division points to be adequate, the electronic musical instrument of this embodiment will come to its stand-by state for the playback processing immediately.

When the user turns on a playback start switch (not shown) among the panel switches 2, the electronic musical instrument of this embodiment will start the playback processing (performance) in accordance with the playback mode designated now. That is, the performance will start on the compressed or expanded time scale according to the designated playback tempo (S105).

In this embodiment, there are provided two kinds of playback modes, i.e. "normal playback mode" and "swing playback mode". The normal playback mode is a mode in which a musical waveform is produced by sequentially reading out the musical waveform data of the respective waveform sub-segments as divided into a plurality from the designated loop segment at a determined constant rate (tempo), whereas the swing playback mode is a mode in which a musical waveform is produced by reading out the musical waveform data of the designated loop segment with the read-out timings fluctuated for respective sub-segments corresponding to respective beat positions or with the read-out rate increased or decreased for respective sub-segments, which consequently give a swing feeling (sensation) to the played-back musical waveform.

Further, the electronic musical instrument of this embodiment may be provided with the following three kinds of normal playback modes and two kinds of swing playback modes.

Normal Playback Modes:

1) at constant read-out rate,
2) at varying read-out rate with the original pitches maintained,
3) at varying read-out rate with the pitches changed, Swing Playback Modes:

1) at constant read-out rate,
2) at varying read-out rate.

The control processing of these playback modes will be described in detail with reference to FIGS. 7–11 later.

Figure 3:
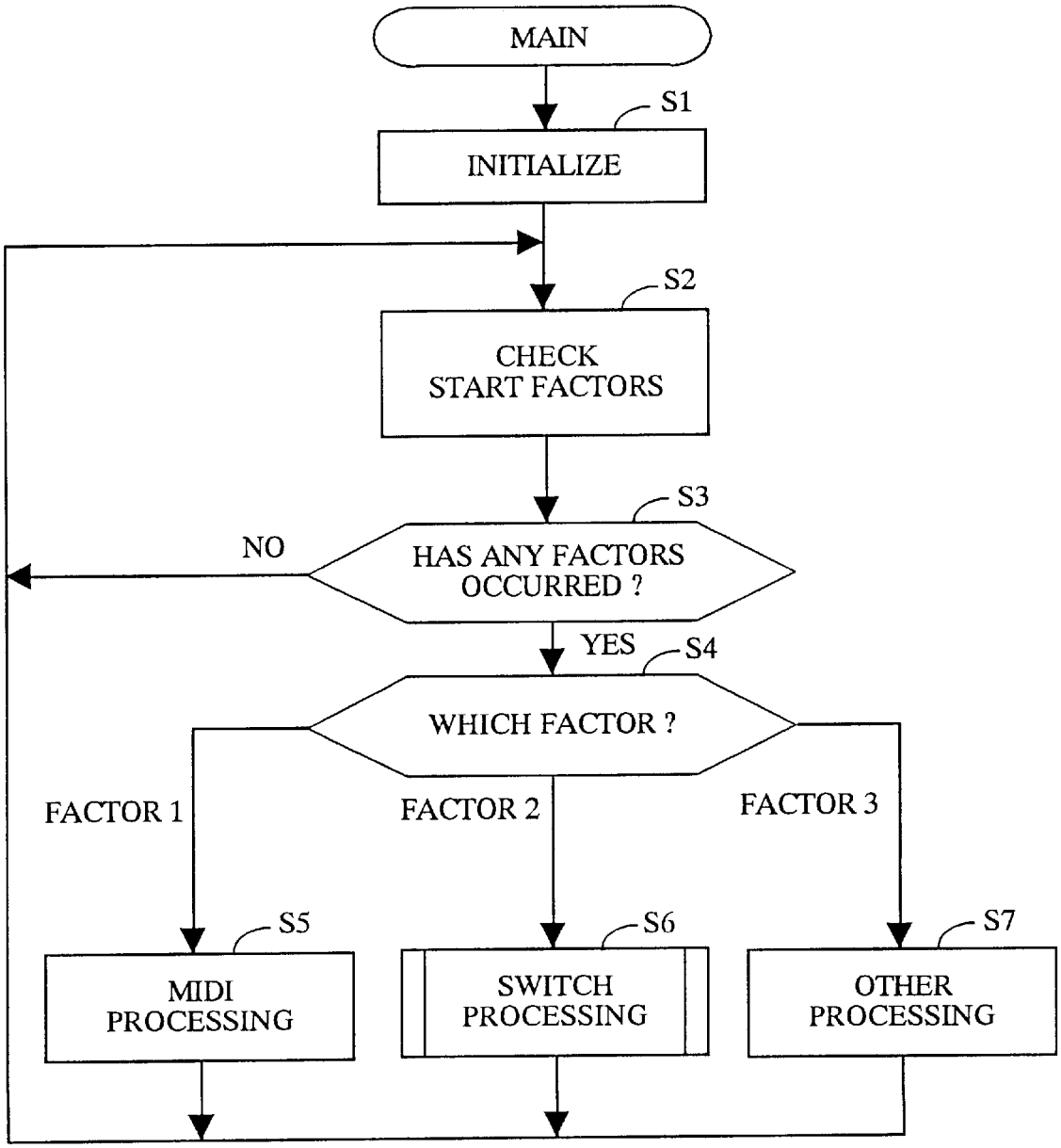
FIG. 3 is a flow chart showing the procedure of the main program executed by the CPU in the electronic musical instrument.

FIG. 3 is a flow chart showing the procedure of the main program which is executed by the electronic musical instrument of this embodiment, especially by the CPU 5. First in step S1, the initialization of the system is performed, including the clearing operation of the RAM 7.

Next, step S2 examines any occurrences of the following start factors.

Start factor 1: A MIDI event has occurred.

Start factor 2: The user turns on (manipulates) any of the switches among the panel switches 2 and accordingly a specifically designated event has been detected.

Start factor 3: Other start factors than start factors 1 and 2 has been detected.

The sub-segments step S3 judges whether any of the above listed start factors 1–3 has occurred or not, and returns the processing back to step S2 when none of the start factors has occurred, or moves the processing forward to step S4 to judge which of the start factors has occurred when any of the start factors 1–3 has occurred.

In case the step S4 judges that "start factor 1" has occurred, the process moves forward to step S5 to conduct a MIDI processing corresponding to the MIDI event occurred. In case the step S4 judges that "start factor 2" has occurred, the process moves forward to step S6 to conduct a switch processing corresponding to the switch event occurred. And in case the step S4 judges that "start factor 3" has occurred, the process moves forward to step S7 to conduct other processing corresponding to the other event occurred. After finishing any of the above steps S5–S7, the process moves back to step S2 to repeat the above described factor dependent processing flow.

FIG. 4 is a flow chart showing the procedure of a loop length set event processing which occurs when the user turns on the loop length set switch (not shown in particular) among the panel switches 2, and this is one of the processings in the switch event processing of step S6 in FIG. 3.

Referring to the flow chart of FIG. 4, when the user specifically designates a loop segment in the stored musical waveform anew, the number of waveform data (i.e. the number of samples) of the loop segment is stored in a data area LL allotted in a work area of the RAM 7 (step S11). The content data value of the area LL is also referred to as a "loop length LL" hereinafter. There can be various ways for designating the loop length, among which the user may simply designate the number of wave sample data as the loop length LL, or the user may designate the start and end points of the loop segment and then the CPU may count the number of wave data included between the loop start point and the loop end point to let the sample number be the loop length LL.

Next, step S12 computes a loop time length LT (in seconds) corresponding to the loop length LL (in samples) using the following formula (1) to determine the measure number MN of the subject loop segment.

The loop time length LT is obtained by:

$$LT=LL/Fs \quad (1),$$

where Fs stands for the sampling frequency (in Hz) with which the musical waveform is sampled.

Now will be explained how the measure number MN (i.e. how many measures there would be in the loop segment) is determined based on the loop time length LT. Taking the tempo for the loop segment as Tm (beats per minute) and the number of beats ("meter beats" in terms of time signature) in a measure as Bm (beats per measure), then the time length LTm of one measure (in seconds) is obtained by:

$$LTm=Bm*60/Tm \quad (2).$$

Therefore the time length of x measures will easily be obtained by multiplying the above-obtained LTm by x. For example, where the tempo is within the range of 80 through 160 (beats per minute) and one measure consists of four beats (meter beats), the correspondence between the number of measures and the time length for those measures is as follows:

1 measure: 1.5–3.0 seconds
2 measures: 3.0–6.0 seconds
4 measures: 8.0–12.0 seconds
8 measures: 12.0–24.0 seconds
16 measures: 24.0–48.0 seconds.

As there is also such music as would be performed in a tempo range other than that exemplified above (e.g. in case of break beats of techno music), the correspondence between the number of measures and the time length for those measures is shown below with respect to the tempo range of 85 through 170 and the tempo range of 90 through 180, respectively.

1) tempo range=85 through 170
1 measure: 1.4–2.8 seconds
2 measures: 2.8–5.6 seconds
4 measures: 5.6–11.3 seconds
8 measures: 11.3–22.6 seconds
16 measures: 22.6–45.2 seconds,
2) tempo range=90 through 180
1 measure: 1.3–2.6 seconds
2 measures: 2.6–5.3 seconds
4 measures: 5.3–10.6 seconds
8 measures: 10.6–21.3 seconds
16 measures: 21.3–42.6 seconds.

Such correspondences between the measure numbers and the measure time lengths are stored as the table data, for example in the ROM 6 with respect to various tempo ranges, and thus the measure number MN can be obtained by searching through the table for the loop time length LT which is obtained by the above formula (1).

Next in step S13, the beat ("rhythm beat" in this context) number per measure is stored in a data area BN allotted in a work area of the RAM 7. The content of the area BN is also referred to as a "beat number BN" hereinafter. As a typical example in this embodiment, a numerical value of "16" is stored for this BN, as a majority of music pieces performed on this electronic musical instrument would very likely be in a 16-beat rhythm. But any other beat number may of course be employed for the BN. For this purpose, the electronic musical instrument according to this invention may be so designed that any other number can be set for the BN value by the user or that the previously used number can be inherited for later use.

The succeeding step S14 is to temporarily subdivide the loop segment equally into MN * BN sub-segments, and step S15 is to find a zero cross point which is near (preferably nearest) to each temporary subdivision point and to determine such found zero-cross points as the definitive subdivision points to define the respective sub-segments. Thus the loop length set event processing comes to its end, and the program execution returns to the main routine. Optionally, there may be included a further step after the step S15 for determining (estimating) a tempo for playback of the loop segment. A manner of tempo determination will be described later.

Figure 5A:
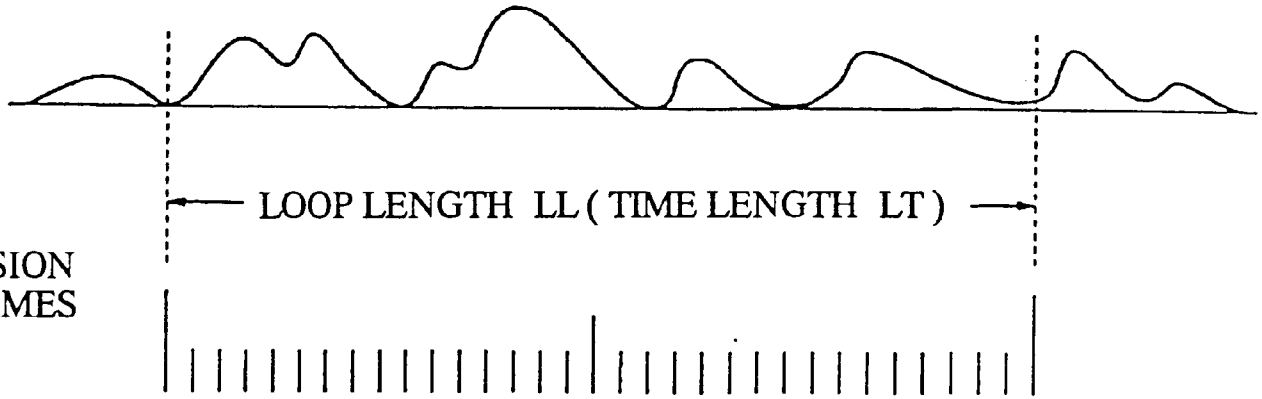
FIGS. 5(*a*) and 5(*b*) are waveform charts for explaining the loop length set event processing of FIG. 4 specifically.
Figure 5B:
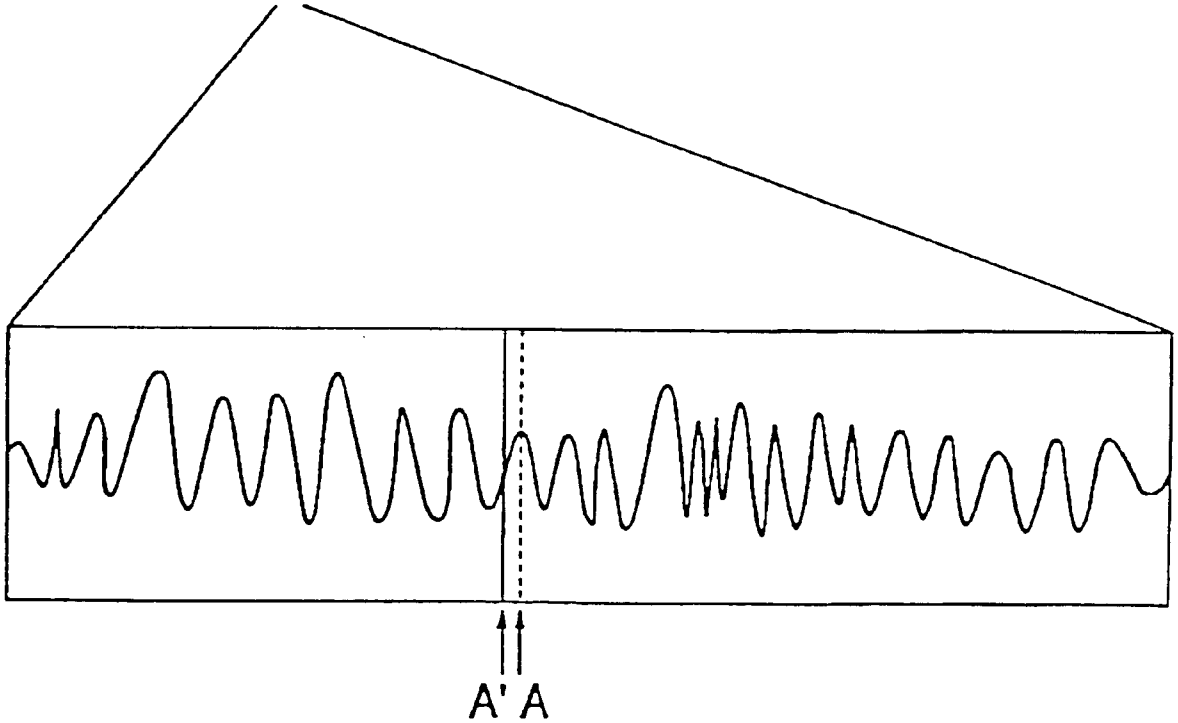

FIGS. 5(*a*) and 5(*b*) are waveform charts for explaining the loop length set event processing more specifically, in which FIG. 5(*a*) shows an example of a musical waveform as read out and designated for a loop segment to be used in loop playback, although the depiction is of the envelope of the musical wave just for a schematic purpose and does not necessarily illustrate the precise and accurate shape of the envelope or vibration of the waveform. And FIG. 5(*b*) shows an enlarged waveform (depicting its vibration) of a fractional portion (of the loop segment) which includes a subdivision point therein.

When a new loop segment having a loop length LL is designated (or specified) as shown in FIG. 5(*a*), a loop time length LT is computed corresponding to the loop length LL, and then a measure number MN is determined corresponding to the loop time length LT (steps S11 and S12). In the case of FIG. 5(*a*), the loop segment designated by the user is determined to have two measures, which in turn are temporarily subdivided by a 16-beat rhythm, i.e. into 32 equal sub-segments (steps S13 and S14). Let it be assumed that the temporary subdivision has been made at a point A as shown in FIG. 5(*b*). As this temporary subdivision point A is not a zero-cross itself, the procedure finds a zero-cross point A' in its vicinity (e.g. the nearest one) and replaces the point A with the zero-cross point A' as a definitive subdivision point (step S15). The same procedure will be taken for other subdivision points. The reason why the zero-cross points are employed is that any of the waveform sub-segments will start at the zero value of the waveform sample, every time the musical waveform is played back in any playback mode, thereby minimizing the occurrence of click noises.

As the above-described loop length set event processing is similar to the automatic division processing, the latter processing will be explained with reference to the former processing. The automatic division processing may be comprised of a process equal to the process which will be conducted when the loop points are designated in step S11 of the loop length set event processing, a process equal to the process which will be conducted when the tempo is determined for the loop segment after the step S15 has been processed, and processes which are the same as the steps S12–S15.

The tempo Tm0 for the normal readout of the loop segment is determined by the following formula (3):

$$Tm0=60*MN*Bm/LT \quad (3),$$

where MN is the number of measures in the loop segment determined by the similar manner to the step S12, Bm is the number of meter beats per measure (in this example, 4), and LT is the loop time length obtained by the above formula (1). As will be understood from the above description, the automatic division processing is conducted according to the manner enumerated as #1) through #4) before. While the above-described automatic division processing of this embodiment determines the tempo and the measure number based on only the loop length LL, further modification may be possible by incorporating spans of the peaks of the wave level in the designated phrase (i.e. loop segment) in addition to the loop length LL to determine the tempo and the measure number.

Figure 6:
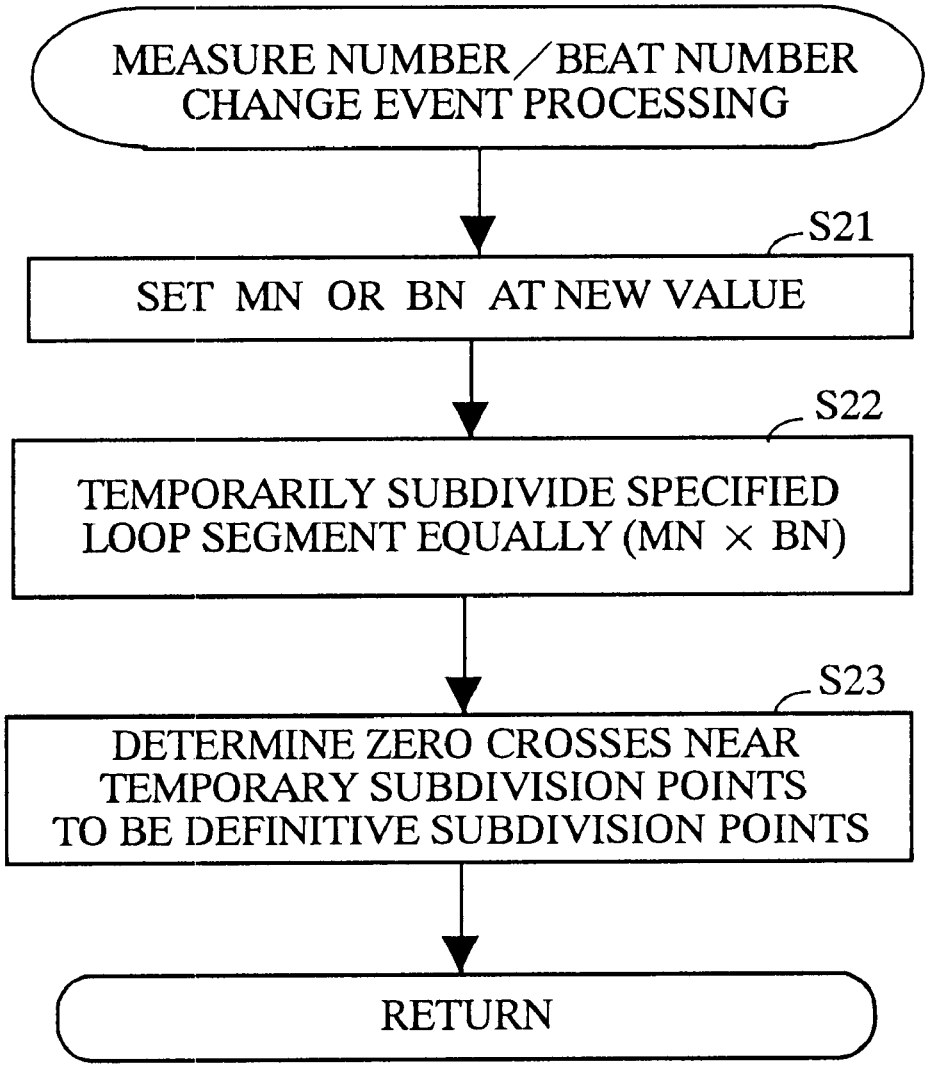
FIG. 6 is a flow chart showing the procedure of measure number change event processing or beat number change event processing which operates when the user turns on the measure number change switch or the beat number change switch.

FIG. 6 is a flow chart showing the procedure of a measure number change event processing and of a beat number change event processing which respectively occur when the user turns on the measure number change switch (not shown in particular) and the beat number change switch (not shown in particular), respectively, among the panel switches 2, and this is one of the processings in the switch event processing of step S6 in FIG. 3. The chart is to illustrate two kinds of processings by one flow, i.e. the measure number change event processing to be performed when the measure number change switch is turned on and the beat number change event processing to be performed when the beat number change switch is turned on. But this is just for the sake of simplicity, where the both processings are performed in a similar manner.

These processings are to change the measure number and/or the beat number both of which are the essential factors for performing an optimal division of the loop segment into sub-segments when the user would not like to accept the subdivision points automatically decided by the electronic musical instrument of this embodiment, as formerly illustrated at step S104 in FIG. 2.

Now in FIG. 6, when the measure number change switch is turned on and a new measure number is designated (specified) by the user, the measure number MN is set at this newly designated measure number, and when the beat number change switch is turned on and a new beat number is designated (specified) by the user, the beat number BN is set at this newly designated beat number (step S21). The measure number change event processing and the beat number change event processing are different from each other only in this step S21, and are the same through the succeeding steps S22 and S23.

The step S22 divides temporarily the designated loop segment into equal sub-segments in a number of MN * BN as in the above-mentioned step S14, and the step S23 finds zero-cross points of the waveform each in the vicinity of each of the temporary subdivision points and determine the zero-cross points as the definitive subdivision points, to end this measure number/beat number change event processing (and the program returns to the main routine). In this event processing, the tempo for the loop segment may be determined anew in the manner described before.

Figure 7:
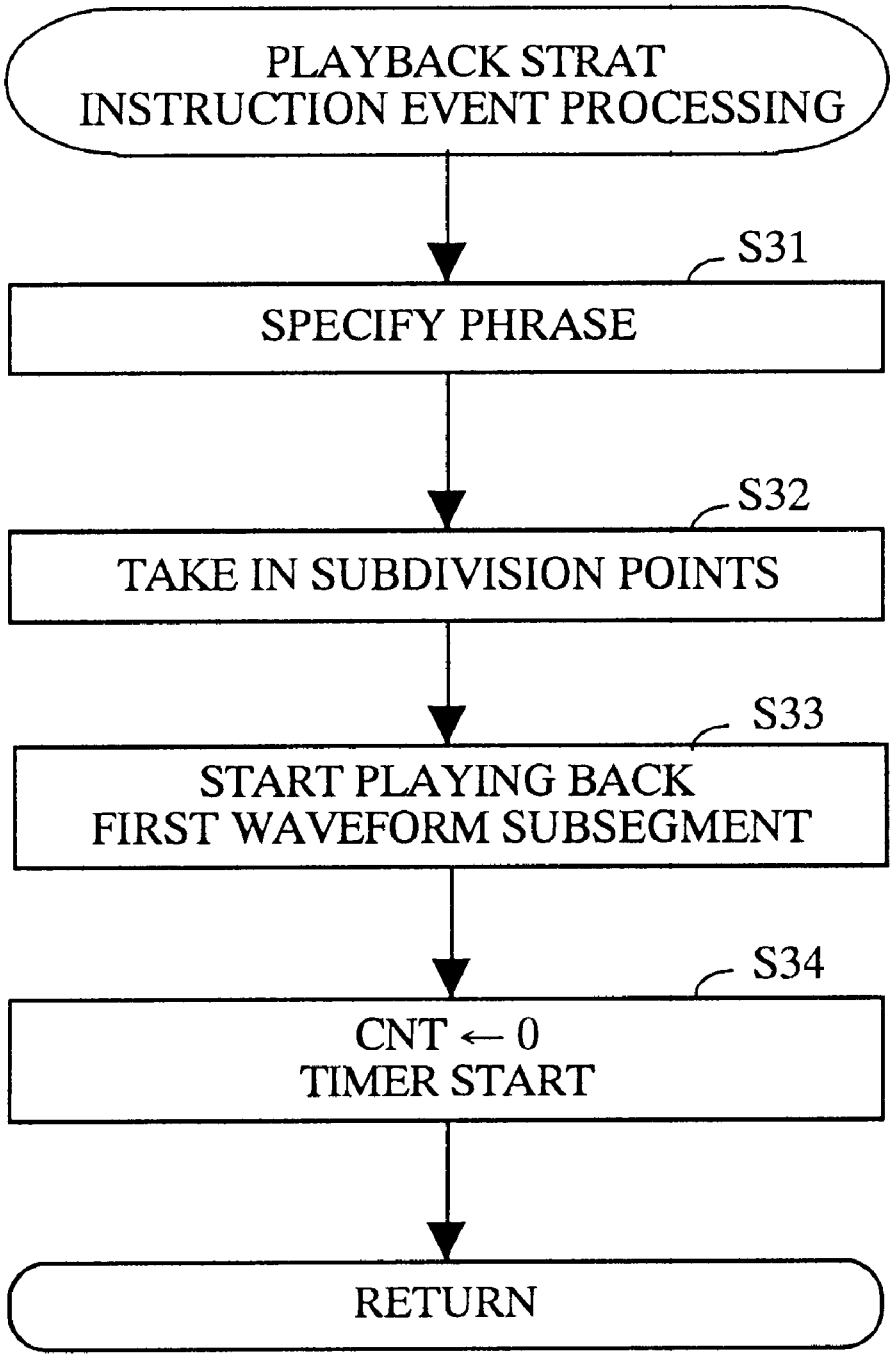
FIG. 7 is a flow chart showing the procedure of the playback start instruction event processing which operates when the user turns on the playback start switch under the condition that the read-out rate constant mode is selected in the normal playback mode.

FIG. 7 is a flow chart showing the procedure of a playback start instruction event processing which occurs when the user turns on the playback start switch (not shown in particular) among the panel switches 2 where the normal playback mode #1) at constant read-out rate is designated, and this is one of the processings in the switch event processing of step S6 in FIG. 3.

Referring to the flow chart of FIG. 7, when the user specifically designates an intended loop segment in the stored musical waveform (step S31), step S32 takes in the subdivision points of the designated phrase (loop segment). This process of taking in the subdivision points is to store the address numbers where the respective waveform data at the respective subdivision points in the designated loop segment in a work area of the RAM 7. The reason why the subdivision points are taken in in this embodiment is that the tone generator circuit 17 is so constructed as to generate (process) a musical waveform handling each of the waveform sub-segments divided at the respective subdivision points as one processing unit.

Then step S33 starts playing back the first waveform sub-segments of the designated phrase (loop segment). Specifically, the step S33 performs various settings so that the tone generator circuit 17 shall read out and generate the first waveform sub-segments. And step S34 resets (to "0") the softwared counter CNT allotted in the RAM 7 as a preparation for detecting the beat timings, and starts the timer 8 which is an interrupt timer for starting the timer interrupt processing as described hereinbelow. Thus the playback start instruction event processing comes to its end.

Figure 8:
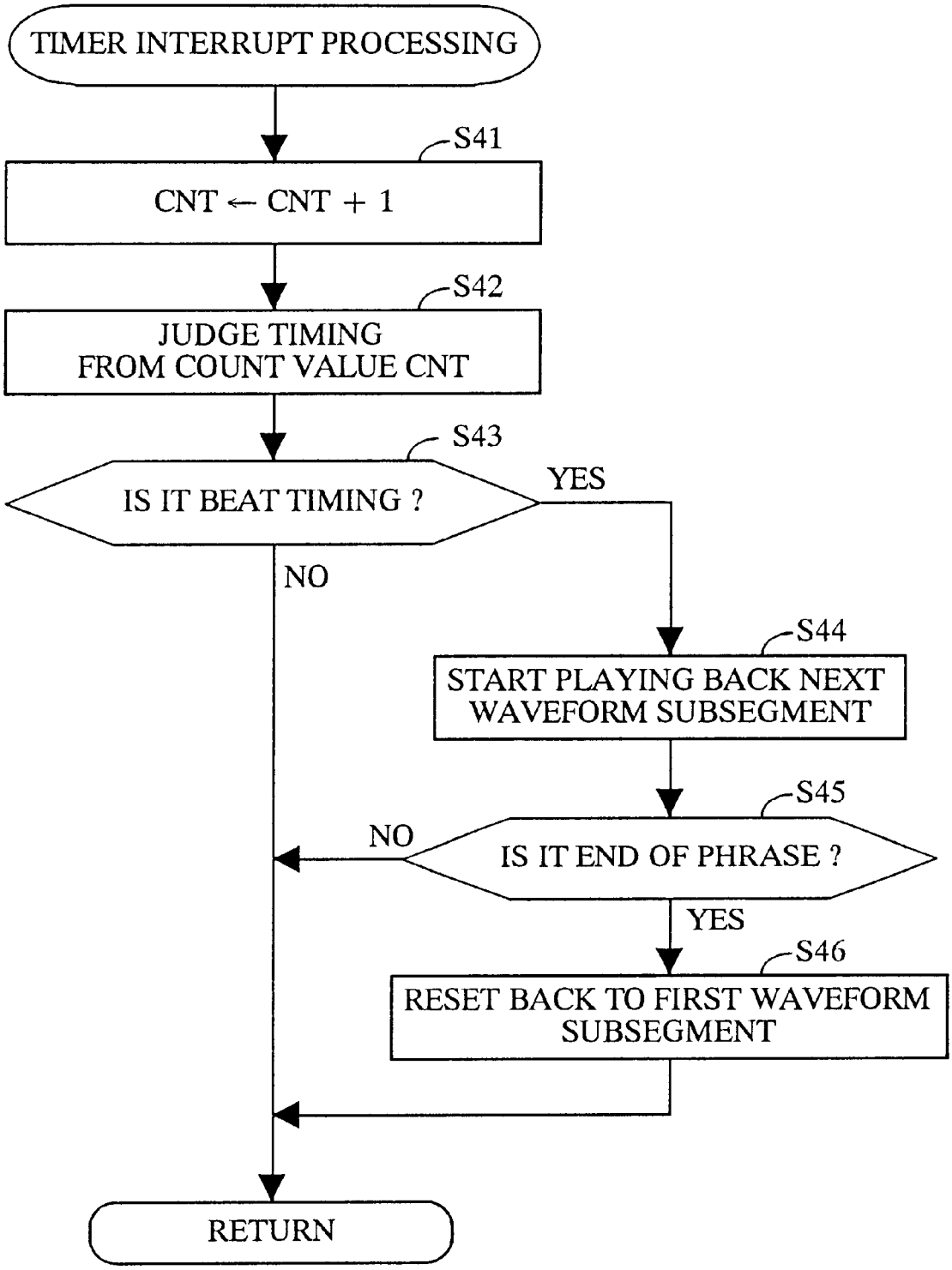
FIG. 8 is a flow chart showing the procedure of the timer interrupt processing which is initiated every time the timer in FIG. 7 counts a predetermined amount of time.

FIG. 8 is a flow chart showing the procedure of a timer interrupt processing which is started every time the timer 8 which was started in the step S34 counts the predetermined time lapse (in this embodiment, the time is set depending on the tempo). This timer interrupt processing is to produce a musical waveform by repeatedly reading out the loop segment (i.e. the phrase designated by the user) in a loop.

Referring to the flow chart of FIG. 8, step S41 first increments the counter CNT by a value "1". Next, step S42 judges what timing of the waveform is now being played back from the count value of the counter CNT, and step S43 discriminates whether the thus judged timing is a beat timing or not. A beat timing in this context means a timing which coincides with any of the rhythm beats. The reason why beat timings can be discriminated by checking the value of the counter CNT is that this timer interrupt processing occurs in synchronization with the tempo progression and that the counter CNT is counting within the timer interrupt processing.

When the step S43 detects that the current playback timing is a beat timing, step S44 starts playing back the next waveform sub-segments similarly as the above step S33 started the first waveform sub-segments, and thereafter step S45 judges whether the now started waveform sub-segments is the last one (end) in the phrase (loop segment). If the step S45 detects that the sub-segments which has just started to be played back is the last one in the loop segment, step S46 sets that the next sub-segments to be played back shall be the first sub-segments of the phrase (loop segment), before ending the timer interrupt processing.

On the other hand, when the step S43 detects that the current playback timing is not a beat timing, or when the step S45 detects that the sub-segments which has just started to be played back is not the last one in the loop segment, the present timer interrupt timing processing comes to its end immediately.

A playback start instruction event processing under the condition that the swing playback mode #1) at constant read-out rate is designated can be implemented by modifying the step S43 of beat timing detection in the following manner. Where the swing playback modes includes two modes, namely a mode in which the read-out rates of respective waveform sub-segments are fluctuated (up and down) for every beat (this corresponds to mode #2) as mentioned before, and a mode in which the read-out timings of respective waveform sub-segments are fluctuated (advanced and delayed) for every beat (this corresponds to mode #1) as mentioned before, the processing of the mode #1) is realized by controlling the step S43 to delay the detection of the timings of up beats (even numbered beats: second, fourth, sixth, . . . ) a little bit and not to change the detection of the timings of down beats (odd numbered beats: first, third, fifth, . . . ).

More particularly, according to the count value of the counter CNT, the beat timings of the down beats are detected at the same timings as the case where the swing playback is not designated, while the beat timings of the up beats are detected at a-little-bit delayed timings. There may be also other control manners than this one.

Figure 9:
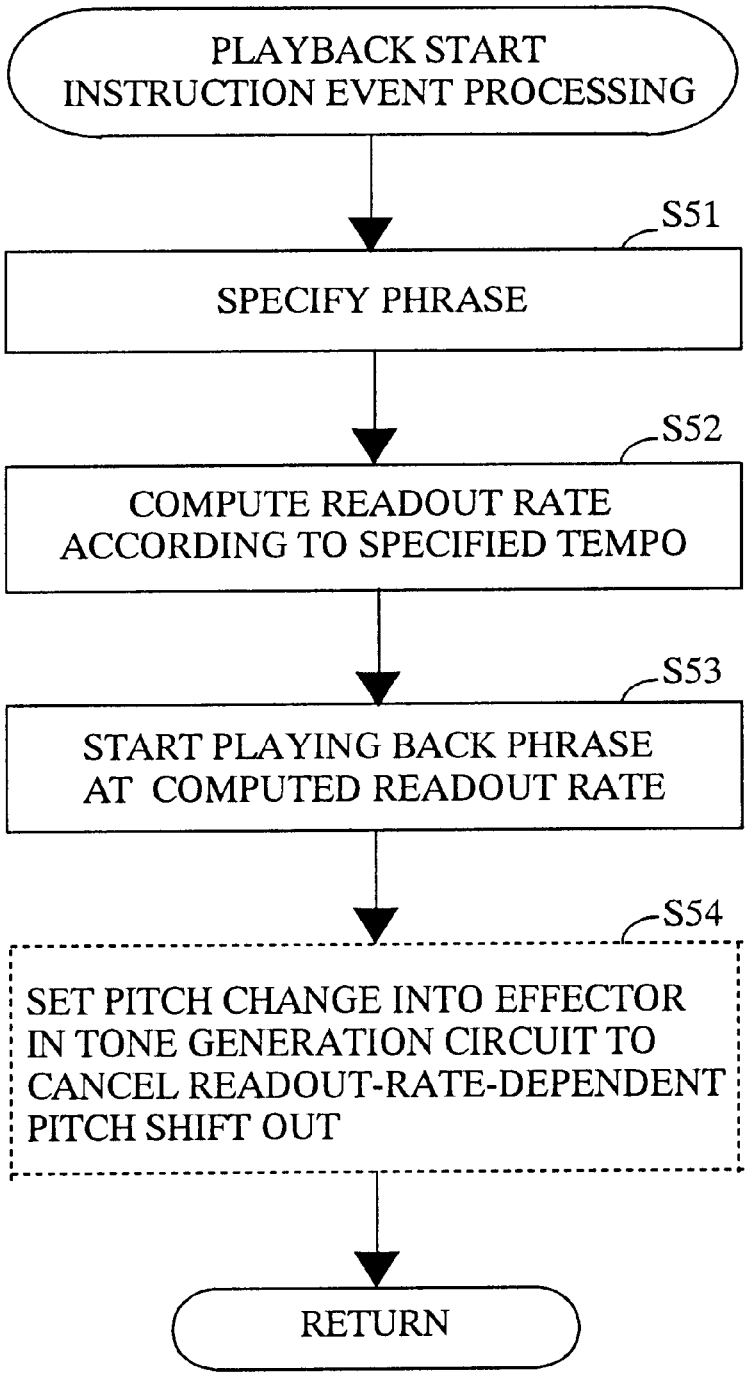
FIG. 9 is a flow chart showing the procedure of the playback start instruction event processing which operates when the user turns on the playback start switch under the condition that the read-out rate variable and pitch variable mode is selected in the normal playback mode.

FIG. 9 is a flow chart showing the procedure of a playback start instruction event processing which occurs when the user turns on the playback start switch (not shown in particular) among the panel switches 2 where the normal playback mode #3) at varying read-out rate with the pitches changed is designated, and this is one of the processings in the switch event processing of step S6 in FIG. 3.

Referring to the flow chart of FIG. 9, step S51 is to specify the phrase (loop segment) which is designated by the user for the phrase to be played back now, similarly as in the step S31 of FIG. 7. Next, step S52 computes a read-out rate in accordance with the tempo designated by the user. The read-out rate is computed as explained as herein below as an example.

Referring to the loop time length LT of the original waveform as LT0, the number of meter beats included in the loop segment as BLT, and the initial tempo as Tm0 which has been determined in the above description, the following formula (4) is derived:

$$LT0=BLT*60/Tm0 \quad (4).$$

In case this original waveform is read out at a tempo Tmx (in beats per meter), the loop time length LTx will be computed by the following formula (5):

$$LTx=BLT*60/Tmx \quad (5).$$

The read-out rate is a rate at which the data samples are read out to constitute a played-back musical waveform signal, and is expressed in terms of an amount of address progress per read-out sampling time (period), i.e. the progressing speed of the address value to which the read-out circuit makes as access for reading out the wave sample values successively. And let us define Rr0 as a read-out rate for playing back a musical waveform so that the played back waveform sounds in the same pitch as the pitch of the original waveform when recorded. In case the recording sampling frequency and the reading-out sampling frequency are the same, this rate Rr0 equals "1". Then, the read-out rate Rrx for reading out the loop segment in the tempo Tmx is computed by the following formula (6):

$$Rrx=Rr0*LT0/LTx=Tmx/Tm0 \quad (6).$$

The succeeding step S53 is to set in the tone generator circuit 17 the loop addresses of the phrase specified at the step S51, and to start playing back the phrase at this computed rate Rrx repeatedly in a loop.

As will be apparent to the reader, a playback start instruction event processing in the aforementioned normal playback mode #2) at varying read-out rate with the original pitches maintained can be realized by adding the succeeding step S54 (as expressed in phantom line) to the above described steps S51–S53. Namely, the step S54 sets into an effector (not shown) in the tone generator circuit 17 the pitch change data which will cancel out the pitch change occurring due to this read-out rate Rrx.

Figure 10:
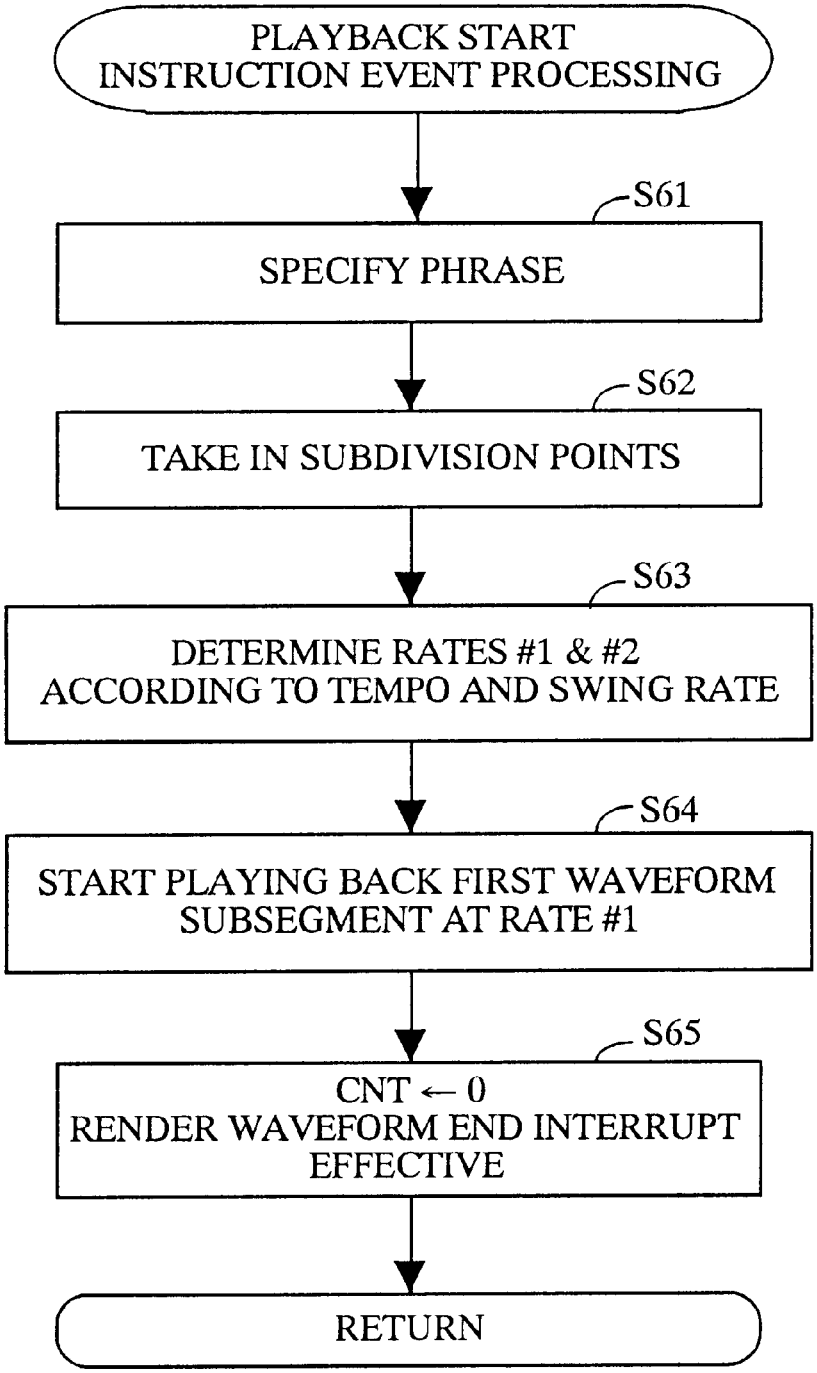
FIG. 10 is a flow chart showing the procedure of the playback start instruction event processing which operates when the user turns on the playback start switch under the condition that the read-out rate variable mode is selected in the swing playback mode.

FIG. 10 is a flow chart showing the procedure of a playback start instruction event processing which occurs when the user turns on the playback start switch (not shown in particular) among the panel switches 2 where the swing playback mode #2) at varying read-out rate is designated, and this is one of the processings in the switch event processing of step S6 in FIG. 3.

Referring to the flow chart of FIG. 10, step S61 specifies the phrase (loop segment) which is designated by the user for the phrase to be played back now, similarly as in the step S31 of FIG. 7. Next, step S62 takes in the subdivision points of the designated phrase (loop segment), similarly as in the step S32 of FIG. 7.

In this figure, however, there are two kinds of read-out rates #1 and #2 computed at step S63 according to the tempo and the swing rate as designated. The rate #1 is for reading out the waveform sub-segments at the down beats (odd numbered beats), and the rate #2 is for the up beats (even numbered beats).

These read-out rates can be easily computed by applying the method as explained at the step S52. For example, in order to lengthen the down beat time length by 1.2 times and shorten the up beat time length by 0.8 times, the first read-out rate shall be obtained by multiplying the original rate by $1/1.2$, and the second read-out rate shall be obtained by multiplying the original rate by $1/0.8$.

In an embodiment of the present invention, the first read-out rate is determined so as to lower the pitch of the played back wave than the original pitch, and the second read-out rate is determined so as to raise the pitch than the original. By reading out the original waveform at the thus determined read-out rate #1, the reading speed will become slower as compared with the case of reading out the waveform without changing the pitch (Rr0=1). On the other hand, by reading out the original waveform at the thus determined read-out rate #2, the reading speed will become faster. The amount of increased time length by slower reading shall be compensated with the amount of decreased time length by faster reading, thereby avoiding vacant time periods between the sub-segments waveforms. Thus a natural swing feeling can be attained on the produced musical tones.

The succeeding step S64 starts playing back the first waveform sub-segments of the phrase designated at the step S61 at the read-out rate #1, and step S65 resets the soft counter CNT to "0" and renders a waveform end interrupt (to be explained later) effective, before ending this playback start instruction event processing.

Although the counter CNT is named here the same as in the step S41 for the simplicity's sake, the functions are not the same. The earlier mentioned counter CNT was to judge the beat timings, but the later mentioned counter CNT is to indicate the location of the sub-segments which is being assigned to the tone generator circuit 17 for tone generation as counted from the top of the designated loop segment (phrase).

Figure 11:
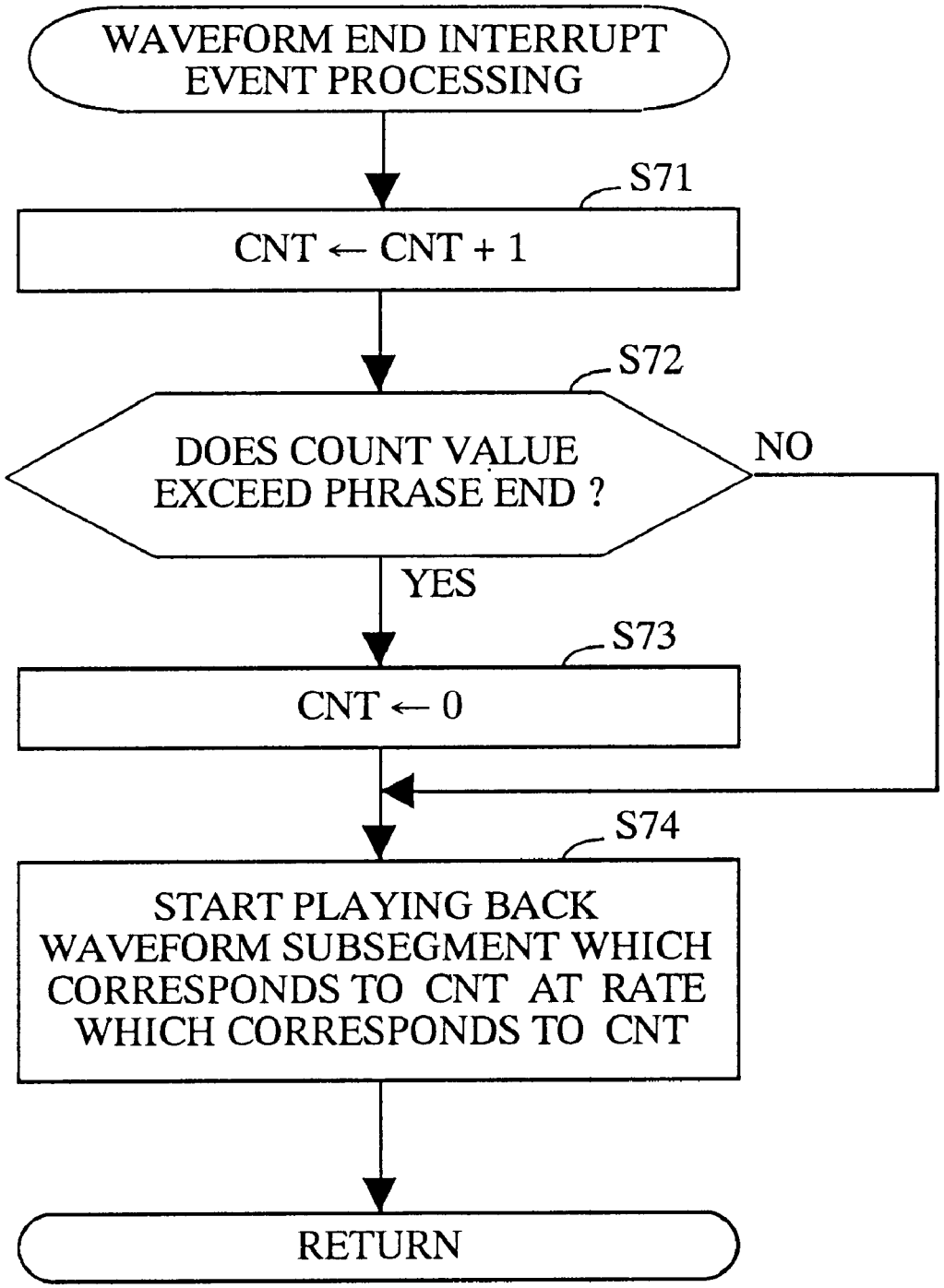
FIG. 11 is a flow chart showing the procedure of the waveform end interrupt event processing which operates when a waveform end interrupt event has occurred.

FIG. 11 is a flow chart showing the procedure of a waveform end interrupt event processing which is conducted when a waveform end interrupt event has occurred. The waveform end interrupt event means an interrupt event which occurs when the tone generator circuit 17 completes reading out the waveform sub-segments designated for read-out.

Referring to the flow chart of FIG. 11, step S71 first increments the counter CNT by a value "1". Next, step S72 checks the count value of the counter CNT to judge whether a sub-segments next to the last sub-segments of the designated phrase is now pointed, and if the count value CNT exceeds the last sub-segments, step S73 resets the counter CNT to "0" to move forward to step S74. And if not, the step S73 is skipped to directly move forward to the step S74.

The step S74 starts playing back the waveform sub-segments which corresponds to the CNT value at a read-out rate which corresponds to the CNT value. In this instance, the respective values of the counter CNT correspond to the respective waveform sub-segments in one-to-one correspondence (for example, CNT=0 corresponds to the initial sub-segments of the designated phrase), and therefore the "waveform sub-segments which corresponds to the CNT" means the waveform sub-segments which is pointed to by the counter CNT value. As described above, the first read-out rate is for the down beats (odd numbered beats) and the second read-out rate is for the up beats (even numbered beats), and therefore "the read-out rates which correspond to the CNT values" are to be readily selected, where the counter CNT value of an even number (this means a down beat, as "0" indicates the first beat), i.e. the LSB (least significant bit) of the CNT value being "0" shall indicate the use of the first read-out rate, and the counter CNT value of an odd number (this means an up beat, as "1" indicates the second beat), i.e. the LSB (least significant bit) of the CNT value being "1" shall indicate the use of the second read-out rate.

With the processings of FIGS. 10 and 11, the pitches of waveform sub-segments exhibit down and up alternately for every other beat, and the listener will feel bouncing sensation in the performed music.

As described in detail above, the embodiment shown permits the user to designate the loop segment in a given musical waveform to be read out in a loop and thereby determining the tempo and the measure number in accordance with the length of the designated loop segment automatically. Therefore, at the time the user has designated the loop segment, the preparation for compressing and/or expanding the time axis (time scale) to fit the tempo will have been completed. And there will be no need of setting the tempo by the user, which facilitates the manipulation of the instrument so that the user can start performance immediately.

Generally, when setting a loop segment, a user (human) listens to the loop segment played back repeatedly and adjusts the loop phrase to fit the object phrase so that the allocated beats sound natural. According to this invention, therefore, the phrase can be divided into sub-segments at maximal subdivision points for scaling the time axis by determining the subdivision points simply using the length of the loop segment.

With the described embodiment where the measure number and the beat number per measure are designated for the specified phrase as a loop segment beforehand and the scaling factor (compression/expansion factor) shall be automatically determined to provide an intended tempo, the user need not calculate the tempo for the intended phrase. This improves the maneuverability of the instrument to a great extent.

The described embodiment is advantageous in providing an interesting performance effect of swinging the beats in a phrase by compressing and/or expanding the time axis of waveform data processing, as the read-out timing of each wave sub-segments in a phrase is controllable for every beat.

The advantages of this invention are summarized in the following. According to the present invention, the loop length of the user-designated loop segment is computed automatically according to the provided configuration and programs, the number of measures of the loop segment is estimated based on the computed loop length, and the tempo for the loop segment is automatically determined based on the estimated number of measures. Therefore, at the time the user has designated the loop segment, the preparation for compressing and/or expanding the time axis (time scale) to fit the tempo will have been completed. And there will be no need of setting the tempo by the user, which facilitates the manipulation of the instrument so that the user can start performance immediately.

Further according to the invention, the designated loop segment is divided into a plurality of sub-segments in accordance with the number of measures estimated by the measure number estimating means and the number of beats designated by the beat number designating means. Therefore, the subdivision points to make sub-segments are determined using the loop length which is represented by the estimated number of measures. Thus, the loop segment can be subdivided at optimal points for time axis scaling.

Further, the scaling factors for reading out the waveform sub-segments are determined by computation based on the loop length computed by the loop length computing means, the number of beats designated by the beat number designating means and the playback tempo designated by the playback tempo designating means, which dispenses with laborious calculation of the tempos for the designated loop segment and provides improved maneuverability of the instrument.

Further, there is provided scale factor determining means which computes a first scale factor for reading out the waveform sub-segments in a compressed state and a second scale factor for reading out the waveform sub-segments in an expanded state so that the waveform playback means shall produce a music waveform by alternately compressing and expanding the waveform sub-segments by using the computed first and second scale factors alternately. So, by simply taking a phrase of waveform as a loop segment, scale factor control can be effected partly within the phrase. Further, the pitches of the waveform sub-segments can be fluctuated up and down alternately, which realizes production of bouncing musical tones, i.e. musical tones imparted with a swing feeling. Further in such a situation, the amount of compression of the waveform sub-segments by the first scale factor for the time axis and the amount of expansion of the waveform sub-segments by the second scale factor can be so determined as to cancel each other, thereby avoiding any occurrence of vacant time periods between the waveform sub-segments, still keeping a natural swing feeling on the produced musical wave.

While several forms of the invention have been shown and described, other forms will be apparent to those skilled in the art without departing from the spirit of the invention. Therefore, it will be understood that the embodiments shown in the drawings and described above are merely for illustrative purposes, and are not intended to limit the scope of the invention, which is defined by the appended claims.

What is claimed is:

1. An electronic musical instrument comprising:

waveform data storing means for storing musical waveform data, loop segment designating means for permitting a user of the instrument to designate a loop segment which is a waveform segment within the stored musical waveform data to be repetitively utilized in a loop, loop length computing means for computing the length of said designated loop segment, measure number estimating means for estimating how many measures there would be in said designated loop segment in accordance with the computed loop length under the condition that a tempo of performing said designated loop segment should be of a value falling within a predetermined range, tempo determining means for determining a tempo in which said designated loop segment is to be played back, based on the estimated number of the measures, and waveform playback means for playing back a musical waveform by repetitively reading out in said determined tempo the waveform of said designated loop segment.

2. An electronic musical instrument as claimed in claim 1, further comprising:

beat number designating means for designating the number of beats to be included per measure, and dividing means for dividing the waveform of said designated loop segment into a plurality of waveform sub-segments, said dividing means dividing the waveform of said designated loop segment into the plurality of waveform sub-segments in accordance with the estimated measure number and the designated beat number per measure.

3. An electronic musical instrument as claimed in claim 2, further comprising:

playback tempo designating means for permitting the user of the instrument to designate the tempo in which said musical waveform is to be played back, and scale factor determining means for determining scale factors to be applied to said divided waveform sub-segments by computation based on said computed loop length, said designated beat number and said designated playback tempo, and wherein said waveform playback means reads out said divided waveform sub-segments with said determined scale factor to play back the musical waveform.

4. An electronic musical instrument as claimed in claim 3, wherein said scale factor determining means computes a first scale factor for compressing said waveform sub-segments along a time axis and a second scale factor for expanding said waveform sub-segments along a time axis, and said waveform playback means plays back a musical waveform by alternately compressing and expanding said waveform sub-segments respectively along a time axis using said computed first and second scale factors.

5. An electronic musical instrument comprising:

waveform data memory for storing musical waveform data, loop segment designating circuit for permitting a user of the instrument to designate a loop segment which is a waveform segment within the stored musical waveform data to be repetitively utilized as a loop, loop length computing circuit for computing the length of said designated loop segment, measure number estimating circuit for estimating how many measures there would be in said loop segment in response to the computed loop length under the condition that a tempo of performing said designated loop segment should be of a value falling within a predetermined range, tempo determining circuit for determining a tempo in which said designated loop segment is to be played back, based on the estimated number of the measures, and waveform playback circuit for playing back a musical waveform by repetitively reading out in said determined tempo the waveform of said designated loop segment.

6. A method for performing music by playing back a waveform segment repetitively in a loop, comprising the steps of:

providing musical waveform data constituting performance of music, permitting a user of the instrument to designate a loop segment which is a waveform segment within said provided musical waveform data to be repetitively utilized in a loop, computing the length of said designated loop segment, estimating how many measures there would be in said loop segment in accordance with the computed loop length under the condition that a tempo of performing said designated loop segment should be of a value falling within a predetermined range, determining a tempo in which said designated loop segment is to be played back, based on the estimated number of the measures, and playing back a musical waveform by repetitively reading out in said determined tempo the waveform of said designated loop segment.

7. A machine readable medium for use in an electronic musical instrument of a data processing type comprising a computer and loop segment designating means for designating a waveform segment to be utilized in a loop, said medium containing program instructions executable by said computer for causing the electronic musical instrument to perform the steps of:

providing musical waveform data constituting performance of music, rendering said loop segment designating means operative to permit a user of the instrument to designate a loop segment which is a waveform segment within said provided musical waveform data to be repetitively utilized in a loop, computing the length of said designated loop segment, estimating how many measures there would be in said loop segment in accordance with the computed loop length under the condition that a tempo of performing said designated loop segment should be of a value falling within a predetermined range, determining a tempo in which said designated loop segment is to be played back, based on the estimated number of the measures, and playing back a musical waveform by repetitively reading out in said determined tempo the waveform of said designated loop segment.

8. An electronic musical apparatus comprising:

a waveform data storing device which stores musical waveform data, a loop segment designator which permits a user of the apparatus to designate a loop segment which is a waveform segment within the stored musical waveform data to be repetitively utilized in a loop, a loop length obtaining device which obtains the length of said designated loop segment, a measure number estimator which estimates how many measures there would be in said designated loop segment in accordance with the obtained loop length under the condition that a tempo of performing said designated loop segment should be of a value falling within a predetermined range, a tempo determining device which determines a tempo in which said designated loop segment is to be played back, based on the estimated number of the measures, and a waveform playback device which plays back a musical waveform by repetitively reading out in said determined tempo the waveform of said designated loop segment.

9. An electronic musical apparatus as claimed in claim 8, further comprising:

a beat number designator which designate the number of beats to be included per measure, and a waveform divider which divides the waveform of said designated loop segment into a plurality of waveform sub-segments, said waveform divider dividing the waveform of said designated loop segment into the plurality of waveform sub-segments in accordance with the estimated measure number and the designated beat number per measure.

10. An electronic musical apparatus comprising:

a waveform data memory which stores musical waveform data, a loop segment designating circuit for permitting a user of the instrument to designate a loop segment which is a waveform segment within the stored musical waveform data to be repetitively utilized as a loop, a loop length computing circuit which computes the length of said designated loop segment, a measure number estimating circuit which estimates how many measures there would be in said loop segment in response to the obtained loop length under the condition that a tempo of performing said designated loop segment should be of a value falling within a predetermined range, a tempo determining circuit for determining a tempo in which said designated loop segment is to be played back, based on the estimated number of the measures, and a waveform playback circuit for playing back a musical waveform by repetitively reading out in said determined tempo the waveform of said designated loop segment.

* * * * *